US011247822B2

(12) United States Patent
Krasiev et al.

(10) Patent No.: US 11,247,822 B2
(45) Date of Patent: Feb. 15, 2022

(54) CONTAINER WITH MULTILAYER SELF-ADHESIVE RECLOSABLE STICKER

(71) Applicant: PHILIP MORRIS PRODUCTS S.A., Neuchatel (CH)

(72) Inventors: Sergey Krasiev, Le Mont-sur-Lausanne (CH); Arjen Hamilcar Slooff, Rhenen (NL); Dorothy Tritz, Yverdon-les-bains (CH)

(73) Assignee: Philip Morris Products S.A., Neuchatel (CH)

( * ) Notice: Subject to any disclaimer, the term of this patent is extended or adjusted under 35 U.S.C. 154(b) by 360 days.

(21) Appl. No.: 15/503,824

(22) PCT Filed: Oct. 13, 2015

(86) PCT No.: PCT/EP2015/073719

§ 371 (c)(1),
(2) Date: Feb. 14, 2017

(87) PCT Pub. No.: WO2016/059077

PCT Pub. Date: Apr. 21, 2016

(65) Prior Publication Data

US 2017/0275082 A1 Sep. 28, 2017

(30) Foreign Application Priority Data

Oct. 14, 2014 (EP) ..... 14188829

(51) Int. Cl.
*B65D 75/58* (2006.01)
*B65D 85/10* (2006.01)

(52) U.S. Cl.
CPC ... *B65D 75/5838* (2013.01); *B65D 85/10568* (2020.05); *B65D 2543/00953* (2013.01); *B65D 2575/586* (2013.01)

(58) Field of Classification Search
CPC ..... B65D 85/1045; B65D 75/5838; B65D 2575/586; B65D 2543/00953
(Continued)

(56) References Cited

U.S. PATENT DOCUMENTS 8,091,703 B2 1/2012 Marchetti
8,181,783 B2 5/2012 Kakura
(Continued)

FOREIGN PATENT DOCUMENTS

CN 101628651 1/2010
CN 101918289 12/2010
(Continued)

OTHER PUBLICATIONS

PCT Search Report and Written Opinion for PCT/EP2015/073719 dated Dec. 4, 2015 (10 pages).
(Continued)

*Primary Examiner* — Anthony D Stashick
*Assistant Examiner* — James M Van Buskirk
(74) *Attorney, Agent, or Firm* — Mueting Raasch Group

(57) ABSTRACT

A hinge-lid container comprises a resealable package of consumer goods, the package having an opening through which consumer goods can be removed; and a self-adhesive reclosable sticker covering the opening of the package and extending beyond the periphery of the opening of the package. The sticker comprises a first and a second layer of labelling web material. The first layer is affixed to the package by a first adhesive provided on the inner surface of the first layer extending about at least a sealing portion of the package at the periphery of the opening. The first layer comprises a cut-out aligned with the opening of the package. The second layer is at least partially releasably affixed to the first layer by a second adhesive provided on a first area of the inner surface of the second layer extending about at least the
(Continued)

lower periphery of the cut-out of the first layer. The second adhesive is a removable adhesive and a peel strength for peeling the first layer from the package is greater than a peel strength for peeling the second layer from the first layer. The second layer of the self-adhesive reclosable sticker is permanently affixed to the inner surface of the lid.

19 Claims, 2 Drawing Sheets

(58) Field of Classification Search
USPC ..... 206/274, 818, 460, 494, 265
See application file for complete search history.

(56) References Cited

U.S. PATENT DOCUMENTS

| | | | | |
|---|---|---|---|---|
| 9,815,613 | B2 * | 11/2017 | Seyfferth De Oliveira | B65D 85/1045 |
| 9,856,405 | B2 * | 1/2018 | Ha | C09J 151/085 |
| 10,081,484 | B2 * | 9/2018 | Pilzecker | B65D 85/1018 |
| 2011/0068155 | A1 * | 3/2011 | Yoshimura | B65D 5/5425 229/117.27 |
| 2012/0002673 | A1 | 10/2012 | Hebert | |
| 2013/0056486 | A1 * | 3/2013 | Latta | B65D 75/5838 220/833 |
| 2015/0151885 | A1 | 6/2015 | Nakano | |

FOREIGN PATENT DOCUMENTS

| | | | | |
|---|---|---|---|---|
| CN | 104010943 | | 8/2014 | |
| EA | 201000728 | | 10/2010 | |
| EP | 2208691 | | 7/2010 | |
| EP | 2471725 | | 7/2012 | |
| EP | 2769930 | | 8/2014 | |
| GB | 2451180 | | 1/2009 | |
| GB | 2451180 | | 2/2012 | |
| JP | 2009-113819 | | 5/2009 | |
| RU | 2455214 | C2 | 7/2012 | |
| WO | WO 2008/062159 | | 5/2008 | |
| WO | WO 2008/142540 | | 11/2008 | |
| WO | WO 2012/089812 | | 7/2012 | |
| WO | WO-2013098109 | A1 * | 7/2013 | B65D 85/1045 |
| WO | WO 2013/120913 | | 8/2013 | |
| WO | WO 2013/183372 | | 12/2013 | |
| WO | WO-2014128037 | A1 * | 8/2014 | B65D 85/1018 |

OTHER PUBLICATIONS

Office Action issued in the Philippines for Application No. 1/2016/502545 dated Jul. 27, 2018 (5 pages).
Office Action issued in China for Application No. 201580052991.0 dated Jul. 4, 2018 (16 pages). English translation included.
European Extended Search Report for Application No. 14188829.7-1708 dated Apr. 1, 2015 (6 pages).
Office Action issued in Kazakhstan for Application No. 2017/0378.1 dated Aug. 27, 2018 (8 pages). English translation included.
Office Action issued in Russia for Application No. 2017116548 (9 pages). English translation included.
Office Action issued in China for Application No. 201580052991.0 dated May 22, 2019 (16 pages). English translation included.
Office Action issued in Japan for Application No. 2017-519529 dated Dec. 5, 2019 (7 pages). English translation included.
Office Action issued in Brazil for Application No. 112017005176 (5 pages). English translation included.

* cited by examiner

CONTAINER WITH MULTILAYER SELF-ADHESIVE RECLOSABLE STICKER

This application is a U.S. National Stage Application of International Application No. PCT/EP2015/073719, filed Oct. 13, 2015, which was published in English on Apr. 21, 2016 as International Publication No. WO 2016/059077 A1. International Application No. PCT/EP2015/073719 claims priority to European Application No. 14188829.7 filed Oct. 14, 2014.

The present invention relates to a container for consumer goods comprising a self-adhesive reclosable sticker. The container of the present invention finds particular application as a container for elongate consumer good items, such as smoking articles.

Smoking articles such as cigarettes and cigars are typically packaged in rigid hinge-lid containers. The bundle of smoking articles housed in the box is commonly wrapped in an inner liner, or package, of metallised paper, metal foil or other flexible sheet material. To access the bundle of smoking articles within the inner liner, a consumer should remove a pre-perforated upper portion of the inner liner upon first opening of the hinge-lid container.

It is also known to enclose consumer goods, for example a bundle of smoking articles, in a resealable substantially airtight wrapper which may include a self-adhesive reclosable sticker. The wrapper encloses the consumer goods and may be inserted into a hinge-lid container. For example, containers are known from WO-A-2008/142540 wherein smoking articles are enclosed in an inner package with an extraction opening removably closed by a cover flap. The cover flap is releasably affixed to the inner package using non-dry adhesive applied to the underside of the cover flap. Inner packages as described in WO-A-2008/142540 may be received in a hinge-lid container, the cover flap being glued permanently and non-removably to an inner surface of the front wall of the lid. This is so that opening and closing of the lid simultaneously opens and closes the cover flap, thus revealing the extraction opening.

For effective bonding of the self-adhesive reclosable sticker adhesive label to the inner package, it is necessary that the self-adhesive reclosable sticker adhesive label be applied onto an even surface. Thus, the self-adhesive reclosable sticker adhesive label can substantially only be applied onto the blank from which the inner package is formed before the blank is wrapped around a bundle of consumer articles. This is true, in particular, where a reinforcement element, such as an inner frame, is wrapped around the bundle of consumer articles and placed inside the inner package. Consequently, the manufacturing process of the known resealable packages of this type is not very flexible.

In addition, in known resealable packages of this type a portion of the adhesive label overlying the portion of inner package immediately surrounding the access opening is affixed to the inner package by releasable adhesive. It is critical that the adhesive label extends beyond the periphery of the access opening by a sufficient width, so that proper sealing of the access opening is ensured and, accordingly, the product may have a sufficiently long shelf-life. It is also important to preserve the freshness of the consumer articles once the container and the inner package have been opened for the first time.

It would be desirable to provide a container for consumer goods that makes the manufacturing process of a container with a self-adhesive reclosable sticker easier and more flexible. Further, it would be desirable to provide a container for consumer goods whereby an improved sealing of the access opening of the package may be achieved, while at the same time also ensuring a sufficient shelf-life of the products, and preserving the freshness of the remaining products once the access opening of the package has been opened for the first time.

According to the present invention, there is provided a hinge lid container for consumer goods. The container comprises a box and a lid hinged to the box along a hinge line extending across a back wall of the container. Further, the container comprises a package of consumer goods within the box, the package having an access opening through which consumer goods can be removed. Further, the container comprises a self-adhesive reclosable sticker covering the access opening of the package and extending beyond the periphery of the access opening of the package. The self-adhesive reclosable sticker comprises at least a first and a second layer of labelling web material. The first layer is affixed to the package by a first adhesive provided on the inner surface of the first layer extending about at least a sealing portion of the outer surface of the package located at the periphery of the access opening. Further, the first layer comprises a cut-out at least partly aligned with the access opening of the package. The second layer is affixed to the first layer by a second adhesive provided on a first area of the inner surface of the second layer extending about at least the lower periphery of the cut-out of the first layer. The second adhesive is a removable adhesive, and a peel strength for peeling the first layer from the package is greater than a peel strength for peeling the second layer from the first layer. The second layer of the self-adhesive reclosable sticker is permanently affixed to the inner surface of the lid, such that upon opening the lid the second layer of the self-adhesive reclosable sticker is peeled away to at least partly reveal the access opening.

The term "package" is used in the present specification to refer to any wrapped or boxed consumer article or group of consumer articles. The "access opening" defines an aperture in the package through which the consumer can access the consumer goods inside the package and through which the consumer goods can be removed from the package.

By the expression "self-adhesive resealable sticker", reference is made throughout this specification to a portion, such as for example a strip or tab, of a labelling web material coated on one side with an adhesive substance such as to be adapted to be detached from a surface and securely reattached to it a number of times. The self-adhesive resealable sticker covers the access opening of the package and extends beyond its periphery so that it overlies a portion of the outer surface of the package and can be affixed to it. A sealing portion of the outer surface of the package is thus defined, which extends about the periphery of the access opening. The first adhesive attaching the first layer to the package is provided at least over the sealing portion of the outer surface of the package.

The term "peel strength" is used to refer to the force required to separate a flexible adherend from a (generally more rigid) substrate to which it has been bonded by means of the adhesive. In more detail, in the present specification the term "peel strength" is used to refer to the force required for peeling a layer of labelling web material from an underlying substrate, whether the substrate is a surface of the package or another layer in the same reclosable sticker.

For the determination of the properties of an adhesive, reference may be made for example to internationally approved standard methods developed by FINAT (Fédération INternationale des fabricants et transformateurs d'Adhésifs et Thermocollants sur papiers et autres supports).

Testing method "FTM 2—Adhesive detachment test (90 degrees) at 300 millimetres per minute" assesses the peel strength of a pressure-sensitive adhesive, that is, the force needed for detaching a pressure-sensitive adhesive from a standard testing board. In more detail, a test strip having a width of 25 millimetres and a length of at least 175 millimetres is adhered to a standard glass plate through the exertion of pressure by a 2 kilograms roller. The sample strip is detached at an angle of 90 degrees at a constant speed of 300 millimetres per minute after a contact time of 20 minutes, 24 hours or 1 week, and the strength required for detaching the sample strip is recorded. For a testing board, alternatives to glass substrates such as stainless steel, PE or aluminium may also be used. It shall be appreciated that the strength required for detaching the same pressure-sensitive adhesive from different substrates will vary and may be affected by the surface finish of the testing board. Thus, in order to compare the peel strength of different adhesives, it is essential that their adhesion properties are all tested on testing boards having substantially the same characteristics.

Testing method "FTM 9—Loop Tack measurement" is designed to assess the tack of a pressure-sensitive adhesive. In practice, this test measures the force required to separate at a specified speed a loop of material with the adhesive facing outwards from a specified area of a standard surface. In more detail, a sample strip having a width of 25 millimetres and a length of at least 175 millimetres is formed into a loop and brought into contact with a glass plate at a constant speed of 300 millimetres per minute. As soon as a contact area of 25 millimetres by 25 millimetres is created, the loop is withdrawn and the force required to separate the loop from the testing board is recorded. This force is often referred to as the loop tack.

The international standard methods for measuring the peel strength of an adhesive define reproducible test conditions and, accordingly, provide peel strength values that enable a comparison between different adhesives. However, it shall be understood that, in general, the force needed to detach a flexible adherend from a substrate to which the adherend has been bonded shall depend on the surface properties, for example, the surface finish, of the substrate, as well as on the characteristics of the flexible adherend. Thus, the peel strength of a pressure sensitive label affixed onto a substrate with a roughened finish shall generally be lower than the peel strength of the same pressure sensitive label affixed onto a substrate with a polished finish. Similarly, it shall be understood that the peel strength of the same pressure sensitive label can be reduced if the substrate is coated with a material such as silicone or a wax. In contrast to known containers of the same type, in containers according to the present invention the access opening in the package is covered by at least two layers of labelling web material. The first layer is applied directly onto the package by a first adhesive provided over an area extending at least around the periphery of the access opening (sealing portion). The second layer is applied onto the first layer and is structured and functions substantially as a self-adhesive reclosable sticker adhesive label that can be removed from, and reattached to, the first layer several times. Because the peel strength for peeling the second layer from the first layer is lower than the peel strength for peeling the first layer from the package, it is easy for the consumer to repeatedly open and close the package without risk of damage to the package. It shall be understood that the peel strength for peeling two flexible adherends from the respective underlying substrates may differ because of the nature and properties of the adhesive, because of the surface finish and properties of the underlying substrate or because of both. Thus, by way of example, containers according to the present invention may comprise a self-adhesive reclosable sticker comprising at least two layers, each of which is adhered to the underlying layer or package by a different respective adhesive, the peel strength of the adhesive securing the bottom layer of labelling web material the sticker to the package being greater than the peel strength of the adhesive releasably affixing the immediately overlying layer of labelling web material to the bottom layer. Further, containers according to the present invention may comprise a self-adhesive sticker comprising at least two layers, both of which are adhered to the underlying layer or package by the same adhesive, the peel strength for peeling the overlying layer of labelling web material from the bottom layer of the sticker being made smaller than the peel strength for peeling the bottom layer of the sticker from the package by locally modifying the outer surface, for example by embossing or by the application of a coating, of the bottom layer of the sticker.

In practice, in order to peel the second layer off the first layer and reveal the access opening in the package, the consumer only needs to apply an opening force that is significantly smaller than the force that would be required to detach the first layer from the outer surface of the package. Thus, the risk that, when detaching the second layer from the first layer, the consumer may exert too high a load on the package is greatly limited, if not eliminated altogether.

In the case of the known reclosable containers including a self-adhesive resealable sticker, the force needed to reveal the access opening of the package shall generally be impacted by the characteristics of the laminate material used for form the package, as well as by the package design. By way of example, factors such as the surface finish, the presence of an embossed area or local height differences due to the provision of an inner frame inside the package may all impact the opening force. Thus, the opening force has to be tailored by appropriately selecting suitable adhesives depending on the specific materials and design of each package.

By contrast, with a sticker construction including at least two layers as is the case with containers according to the present invention, the force required for the consumer to reveal the access opening in the package can effectively be controlled and customised based on properties of the components of the sticker alone. In practice, the opening force shall substantially be impacted solely by the properties of the second adhesive and of the labelling material webs forming the first and the second layer, respectively, while there is no dependency from other materials or components used in the container. Thus, according to the present invention, containers can be manufactured that all require substantially the same force to be opened regardless of the material forming the package or of the package design. This is advantageous because it greatly reduces the risk of damage of the surfaces of the container or of malfunction.

Further, for the reasons above, with containers according to the present invention the self-adhesive reclosable sticker may advantageously also easily be applied on an uneven surface, as is the case where a reinforcement frame is provided on the outside of the package. More generally, the self-adhesive reclosable sticker covering the access opening may be advantageously applied on the package after the package containing the consumer articles has been formed, and not necessarily onto the unfolded blank from which the package is to be formed. Thus, compared with known containers of the same type, the manufacture process of containers of the present invention is made more flexible.

In known containers where a self-adhesive reclosable sticker adhesive label is applied directly on an inner package or on an airtight wrapper, the self-adhesive reclosable sticker needs to comprise an area extending beyond the periphery of the opening access. Such containers must also be provided with releasable adhesive that is sufficiently large to ensure the effective sealing of the inner package when the releasable adhesive is affixed over the access opening. In contrast, in packages according to the present invention, the releasable second layer cooperates directly with the underlying first layer and not with the inner package. Proper sealing of the opening access of the inner package, particularly prior to its first opening, is ensured by the tackier, first adhesive, which is applied on the sealing area surrounding the opening access of the inner package. Furthermore, the multi-layer structure of the sticker according to the invention advantageously reinforces the portion of the package surrounding the access opening.

As shall be described in more detail below, one or more of layers in the self-adhesive resealable sticker of containers in accordance with the present invention may be provided with indicia, such as printed indicia, that are hidden when the self-adhesive resealable covers the opening access yet become visible when the second layer is peeled off the first layer. Thus, the multi-layer structure of the self-adhesive resealable sticker of the present invention may further advantageously provide novel ways of presenting indicia or visual content to the consumer, thus resulting in interesting, novel ways of displaying information as well as in an unusual visual impact and in a distinctive product.

As used herein, the terms "front", "back", "upper", "lower", "top", "bottom" and "side", refer to the relative positions of portions of containers according to the invention and components thereof when the package is in an upright position. In the case of a hinge lid container, reference is made to an upright position of the hinge lid container wherein the lid of the outer housing is in the closed position and the hinge line at the back of the container. When describing containers according to the present invention, these terms are used irrespective of the orientation of the container being described. The back wall of the hinged lid container is the wall comprising the hinge line. The term "hinge line" refers to a line about which the lid may be pivoted in order to open the container. A hinge line may be, for example, a fold line or a score line in the panel forming the back wall of the container.

The term "inner surface" is used throughout the specification to refer to the surface of a component of the assembled container that is facing towards the interior of the container, for example towards the consumer goods, when the container is in the closed position. Likewise, the term "outer surface" is used throughout the specification to refer to the surface of a component of the container that is facing towards the exterior of the container. For example, the inner frame comprises an outer surface that is facing the outer housing of the container and an inner surface that is facing the inner package of the container. It should be noted, that the inside or outside surface is not necessarily equivalent to a certain side of a blank used in assembly of the container. Depending on how the blank is folded around the consumer goods, areas that are on the same side of the container can either face towards the inside or the towards the outside of the container.

The term "longitudinal" refers to a direction from bottom to top or vice versa. The term "transverse" refers to a direction perpendicular to the longitudinal direction.

In containers according to the invention, the package comprises an access opening covered by a multi-layer self-adhesive reclosable sticker. In more detail, the self-adhesive reclosable sticker comprises at least a first layer and a second layer of a labelling web material. In particular, the first layer and the second layer of the cover panel may be formed from any suitable thermoplastic material. By way of example, suitable materials include polyethylene terephthalate (PET) and polypropylene (PP).

The first layer is affixed to the package by a first adhesive provided on the inner surface of the first layer on an area extending about at least a sealing portion of the package. The sealing portion is located at the periphery of the access opening and extends substantially about the entire periphery of the adhesive label. Further, the first layer comprises a cut-out in substantial alignment with the access opening of the package.

The first adhesive may be a removable adhesive or a permanent adhesive. Suitable adhesives are known to the skilled person and a wide variety of adhesives are commercially available from a number of suppliers. The selection of a suitable permanent adhesive may depend upon the material forming the package to which the resealable sticker is affixed.

By way of example, the first adhesive may have a peel strength from about 10 to about 100 Newtons/100 millimetres.

In some preferred embodiments, the first layer is substantially permanently affixed to package and the first adhesive is a permanent adhesive.

The second layer is at least partially releasably affixed to the first layer by a second adhesive provided on a first area of the inner surface of the second layer extending about at least the lower periphery of the cut-out of the first layer. The second adhesive is a removable adhesive. Thus, the second layer can be removed from a surface of the first layer and reattached to it a number of times. This allows for repeated opening and closing of the package in order to access the consumer goods individually. The second adhesive on the second layer will preferably provide sufficient adhesion for the second layer to be reattached at least as many times as there are consumer goods within the package. This enables a consumer to open and reseal the package until the package is empty. Suitable removable adhesives are known to the skilled person and a wide variety of adhesives are commercially available from a number of suppliers. The selection of a suitable adhesive may depend upon the material forming the first and the second layers of the cover panel.

The peel strength of the first adhesive is greater than the peel strength of the second adhesive. In more detail, the peel strength of the first adhesive is preferably at least about 110 percent of the peel strength of the second adhesive. More preferably, the peel strength of the first adhesive is at least about 115 percent of the peel strength of the second adhesive. Even more preferably, the peel strength of the first adhesive is at least about 120 percent of the peel strength of the second adhesive.

In some embodiments, the first and the second adhesive may be different adhesives having inherently different peel strengths. In other words, when a same flexible substrate (such as a layer of labelling web material) is affixed to a same support with either adhesive, a different force will need to be exerted on the flexible substrate for detaching it from the support.

In other embodiments, the first and the second adhesive may be the same adhesive, and the peel strength for at least one of the layers of the sticker is altered by modifying the surface properties of the support to which the adhesive is affixed. It shall be clear for the skilled person that the force that needs to be exerted on a flexible substrate affixed by a same adhesive to substrates having different surface properties, such as for example roughness, will be different. Thus, in these embodiments, the surface of the support onto which the layer of labelling web material is affixed by the adhesive will be modified, for example by embossing or by the application of a coating such as silicone or wax or other suitable material that can affect the surface properties typically known in the field and that alters the surface properties. In practice, at least a portion of the outer surface of the first layer may be embossed or coated with silicone to reduce the force needed to peel the second layer away from it.

The second layer may preferably comprise an adhesive-free surface area, wherein this adhesive-free surface area corresponds in size to the cut-out in the first layer. When the cover panel is in the closed position with the second layer sealed to the first layer, this adhesive free surface area covers the cut-out in the first layer. This will prevent dust or small particles, for example tobacco shorts or other residue from the consumer goods within the package, from adhering to the second layer. This may happen, for example, if the second layer label comes into contact with the consumer goods within the inner package.

In an alternative embodiment to having an adhesive-free area corresponding in size to the cut-out in the first layer, the cut-out in the first layer of the cover panel may be defined by one or more lines of weakness in the first layer of the cover panel. The one or more lines of weakness define an access portion of the first layer. By way of example, the access portion of the first layer may be bounded on three sides by lines of weakness. In addition, a further area of the inner surface of the second layer is permanently affixed to the access portion of the first layer bounded by the one or more lines of weakness. The access portion of the first layer is preferably partially separated from the remainder of the first layer along the one or more lines of weakness on first opening the cover panel, such that the access portion of the first layer remains attached to the remainder of the first layer during subsequent opening and closing of the lid of the outer housing. The removable adhesive provided on the first area of the inner surface of the second layer may extend about substantially the entire periphery of the access portion of the first layer.

Preferably, the second layer is permanently affixed to the first layer, at least partially. More preferably, the second layer is permanently affixed to the first layer by a connection portion extending along an edge of the second layer adjacent an edge of the cut-out in the first layer. Preferably, the edge of the cut-out in the first layer is located towards the back of the top of the package.

In some preferred embodiments, the self-adhesive reclosable sticker comprises a pair of flaps extending laterally and permanently affixed to the side walls of the container by a permanent adhesive provided on the inner surface of the flaps. Thus, by having the lateral flaps cooperate with the side walls of the container, a highly enhanced bond between the self-adhesive reclosable sticker and the package may advantageously be achieved.

In more detail, the flaps are provided as lateral extensions of at least the first layer. As an alternative, the flaps may be lateral extensions of both the first and the second layers. In this case, the second layer is preferably permanently affixed to the first layer by a permanent adhesive applied on the inner surface of the flaps of the second layer. This is advantageous in that it stiffens the lateral flaps provides improved structural strength to the top of the package.

The access opening of the package is preferably defined by one or more lines of weakness in the package. By providing the package with an access portion defined by lines of weakness, the package may be even more securely sealed before the first opening of the container, because continuity in the material forming the package may be almost uninterrupted. This may advantageously increase the storage life of the consumer goods contained within the container.

The access portion of the package is preferably partially separated from the remainder of the package along the one or more lines of weakness on first opening of the lid of the outer housing such that the access portion of the package remains attached to the remainder of the inner package during subsequent opening and closing of the lid of the outer housing. The access portion of the first layer is permanently affixed to the access portion of the package.

In those embodiments where the cut-out in the first layer of the cover panel is defined by one or more lines of weakness defining an access portion of the first layer, the lines of weakness in the package are preferably substantially aligned with the lines of weakness in the first layer. Thus, when the container is opened for the first time, the access portion in the package and the access portion in the first layer are both separated, at once, from the remainder of the package and the first layer, respectively.

Preferably, the self-adhesive reclosable sticker extends beyond the periphery of the access opening of the package by less than about 5 millimetres. More preferably, the self-adhesive reclosable sticker extends beyond the periphery of the access opening of the package by less than about 3 millimetres. Even more preferably, the self-adhesive reclosable sticker extends beyond the periphery of the access opening of the package by less than about 1 millimetre.

The self-adhesive resealable sticker may comprise indicia, such as printed indicia. For example, indicia may be provided on the outer surface of the self-adhesive resealable sticker. The indicia provided on the self-adhesive resealable sticker may be different from other indicia that may be provided on the outer surface of the package.

Preferably, the container comprises indicia that are hidden to the consumer by the self-adhesive resealable sticker covering the opening access of the package and that become visible when the second layer is peeled off the first layer to reveal the access opening.

In some embodiments, indicia are provided in at least one layer of the self-adhesive resealable sticker such that the indicia are hidden when the self-adhesive resealable sticker covers the opening access in the package and become visible to the consumer when the second layer is peeled off to reveal the access opening. The indicia provided in the self-adhesive resealable sticker may be different from indicia provided on the outer surface of the package. This advantageously provides a novel way of displaying information to the consumer and gives the container a distinctive visual impact.

By way of example, indicia may be provided on the outer surface of the first layer or on the inner surface of the second layer. Alternatively, or in addition, indicia may be provided on a portion of the outer surface of the package that is covered by the self-adhesive resealable sticker when the self-adhesive resealable sticker is in the closed position, at least the first layer of the self-adhesive resealable sticker being at least partly transparent.

Preferably, the package is formed of metal foil or metallised paper. The package material may be formed as a laminate of a metallised polyethylene film, and a liner material. The liner material may be a supercalendered glassine paper. In addition, the inner package material may be provided with a print-receptive top coating.

Preferably, the container further comprises a reinforcement frame within the inner package. In some embodiments, the reinforcement frame is a U-shaped reinforcement frame. The term "U-shaped" is used to refer to a shape that comprises three parts, wherein the first and the third part are parallel to each other and extend into the same direction perpendicular to the second part. In practice, a U-shaped reinforcement frame is adapted to surround the bundle of consumer goods, for example of smoking articles, on three sides. Typically, a U-shaped reinforcement frame surrounds the bundle of consumer goods on one major face and on the sides, such that the ends of the consumer goods remain uncovered by the reinforcement frame. It shall be appreciated that a reinforcement frame may comprise more than three parts. For example, a reinforcement frame may further comprise a back panel or a pair of back panels, and so forth. As an alternative, in its simplest form, the reinforcement frame may consist of a single front panel.

Alternatively, the reinforcement frame may be provided on the outside of the package and the side walls of the reinforcement frame overlie the sides of the package, thus defining side walls of the container. Advantageously, a reinforcement frame with a large surface area increases the structural strength of the container. The increased structural strength provided by the reinforcement frame allows a secure closing of the self-adhesive reclosable sticker. This is particularly advantageous for subsequent closing operations when the container is no longer full.

In containers according to the present invention, a package with a self-adhesive reclosable sticker as described above may be received in a hinge lid container comprising a box portion and a lid hinged to the box along a hinge line extending across a back wall of the container. As an alternative, the hinge lid container may be formed from folding a corresponding laminar blank about one such package.

Advantageously, the self-adhesive reclosable sticker is affixed to the surface of the lid so that opening and closing of the lid causes opening and closing of the access opening of the package. In practice, the second layer of the cover panel is permanently affixed to the lid, so that when the lid is pivoted about a hinge line extending across the back wall of the hinge lid container, the second layer is peeled off the first layer, which, in contrast, lies permanently affixed to the package.

In some preferred embodiments, the second layer of the self-adhesive reclosable sticker is permanently affixed to the inner surface of the lid by a permanent adhesive provided on a second area of the inner surface of the second layer. Further, a third area of the inner surface of the second layer disposed between the first area and the second area is substantially free of adhesive. Thus, the container may advantageously be closed more easily because the adhesive label does not adhere to itself, or the inner surface of the lid, during opening or closing.

In other preferred embodiments, a second area of the inner surface of the second layer is substantially free of adhesive. Further, the second layer of the self-adhesive reclosable sticker is permanently affixed to the inner surface of the lid by a permanent adhesive provided on a first area of the outer surface of the second layer. Additionally, the second area of the inner surface of the second layer and the first area of the outer surface of the second layer at least partially overlie each other. This advantageously reduces the forces between the backside of the first area of the outer surface and the removable adhesive provided on the first area of the inner surface. Further, this allows the container to be closed more easily because the second layer of the cover panel does not adhere to itself or to the inner surface of the lid during opening or closing.

The hinge lid container is preferably a rectangular parallelepiped comprising two wider walls spaced apart by two narrower walls. The hinge lid container may be formed from any suitable materials including, but not limited to, cardboard, paperboard, plastic, metal, or combinations thereof. Preferably, the hinge lid container and, where present, the inner frame are formed from one or more folded laminar cardboard blanks and preferably, the cardboard has a weight of from about 100 grams per square metre to about 350 grams per square metre.

Hinge lid containers according to the invention may be in the shape of a rectangular parallelepiped, with right-angled longitudinal and right-angled transverse edges. Alternatively, the hinge lid container may comprise one or more rounded longitudinal edges, rounded transverse edges, bevelled longitudinal edges or bevelled transverse edges, or combinations thereof. For example, the hinge lid container according to the invention may comprise, without limitation:

- One or two longitudinal rounded or bevelled edges on the front wall, and/or one or two longitudinal rounded or bevelled edges on the back wall.
- One or two transverse rounded or bevelled edges on the front wall, and/or one or two transverse rounded or bevelled edges on the back wall.
- One longitudinal rounded edge and one longitudinal bevelled edge on the front wall, and/or one transverse rounded edge and one transverse bevelled edge on the back wall.
- One or two transverse rounded or bevelled edges on the front wall and one or two longitudinal rounded or bevelled edges on the front wall.
- Two longitudinal rounded or bevelled edges on a first side wall or two transverse rounded or bevelled edges on the second side wall.

Where the hinge lid container comprises one or more bevelled edge, preferably the bevelled edge has a width of between about 1 millimetre and about 10 millimetres, preferably between about 2 and about 6 millimetres. Alternatively, the hinge lid container may comprise a double bevel formed by three parallel creasing or scoring lines that are spaced such that two distinct bevels are formed on the edge of the container.

Alternatively, the hinge lid container may have a non-rectangular transversal cross section, for example polygonal such as triangular or hexagonal, semi-oval or semi-circular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions, containers according to the invention may be designed to hold different total numbers of smoking articles, or different arrangements of smoking articles. For example, through an appropriate choice of the dimensions, containers according to the invention may be designed to hold a total of between ten and thirty smoking articles.

The smoking articles may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Containers according to the present invention may hold smoking articles of the same type or brand, or of different types or brands. In addition, both filterless smoking articles and smoking articles with various filter tips may be contained, as well as smoking articles of differing length (for example, between about 40 millimetres and about 180 millimetres), diameter (for example, between about 4 millimetres and about 9 millimetres). In addition, the smoking articles may differ in strength of taste, resistance to draw and total particulate matter delivery. Preferably, the dimensions of the container are adapted to the length of the smoking articles, and the collation of the smoking articles. Typically, the outer dimensions of the container are between about 0.5 millimetres to about 5 millimetres larger than the dimensions of the bundle or bundles of smoking articles housed inside the container.

The length, width and depth of containers according to the invention may be such that the resultant overall dimensions of the container are similar to the dimensions of a typical disposable pack of twenty cigarettes.

Preferably, containers according to the invention have a height of between about 60 millimetres and about 150 millimetres, more preferably a height of between about 70 millimetres and about 125 millimetres, wherein the height is measured from the bottom wall to the top wall of the container.

Preferably, containers according to the invention have a width of between about 12 millimetres and about 150 millimetres, more preferably a width of between about 70 millimetres and about 125 millimetres, wherein the width is measured from one side wall to the other side wall of the container.

Preferably, containers according to the invention have a depth of between about 6 millimetres and about 150 millimetres, more preferably a depth of between about 12 millimetres and about 25 millimetres wherein the depth is measured from the front wall to the back wall of the container.

Preferably, the ratio of the height of the container to the depth of the container is in between about 0.3 to 1 and about 10 to 1, more preferably between about 2 to 1 and about 8 to 1, most preferably between about 3 to 1 and 5 to 1

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Preferably, the ratio of the height of the lid back wall to the height of the box back wall of the outer sleeve is between about 0 to 1 (lid located at the top edge of the container) to about 1 to 1, more preferably, between about 1 to 5 and about 1 to 10, most preferably, between about 1 to 6 to about 1 to 8.

Preferably, the ratio of the height of the lid front wall of the outer sleeve to the height of the box front wall of the outer sleeve is between about 1 to 0 (lid covering the entire front wall) to about 1 to 10, more preferably, between about 1 to 1 and about 1 to 5, most preferably, between about 1 to 2 and about 1 to 3.

Where the container comprises smoking articles, the container may further comprise waste-compartments (for example for ash or butts) or other consumer goods, for example matches, lighters, extinguishing means, breath-fresheners or electronics. The other consumer goods may be attached to the outside of the container, contained within the container along with the smoking articles, in a separate compartment of the container or combinations thereof.

The exterior surfaces of containers according to the invention may be printed, embossed, debossed or otherwise embellished with manufacturer or brand logos, trade marks, slogans and other consumer information and indicia.

Once filled, containers according to the invention may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where containers according to the invention are over wrapped, the over wrapper may include one or more a tear tapes. In addition, the over wrapper may be printed with images, consumer information or other data.

Containers according to the invention may be filled and assembled using conventional apparatus and methods, modified to include the step of applying on the package a self-adhesive reclosable sticker as described in detail above covering the access opening of the package and extending beyond the periphery of the access opening of the package. In the step of applying the self-adhesive reclosable sticker on the package, the first layer is affixed to the package by the first adhesive provided on the inner surface of the first layer extending about at least a sealing portion of the package located at the periphery of the access opening and the self-adhesive reclosable sticker is disposed with the cut-out of the first layer substantially aligned with the access opening of the package. Further, where the panel comprises a pair of flaps extending laterally, in the step of applying the self-adhesive reclosable sticker on the package, the flaps are permanently affixed to the side walls of the container by a permanent adhesive provided on the inner surface of the flaps.

The invention will be further described, by way of example only, with reference to the accompanying drawings in which.

Figure 1:
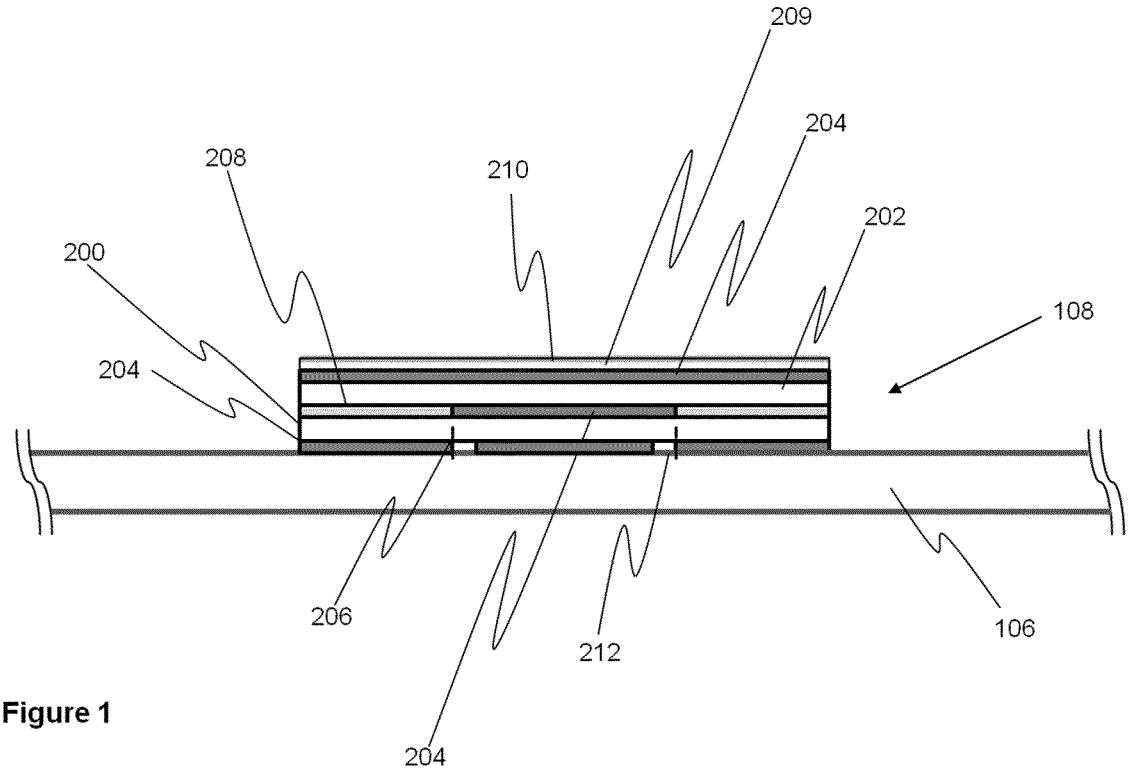
FIG. 1 shows a schematic cross section of the top portion of a resealable container in accordance with the present invention as seen from the front, with the resealable self-adhesive sticker in the closed position.
Figure 2:
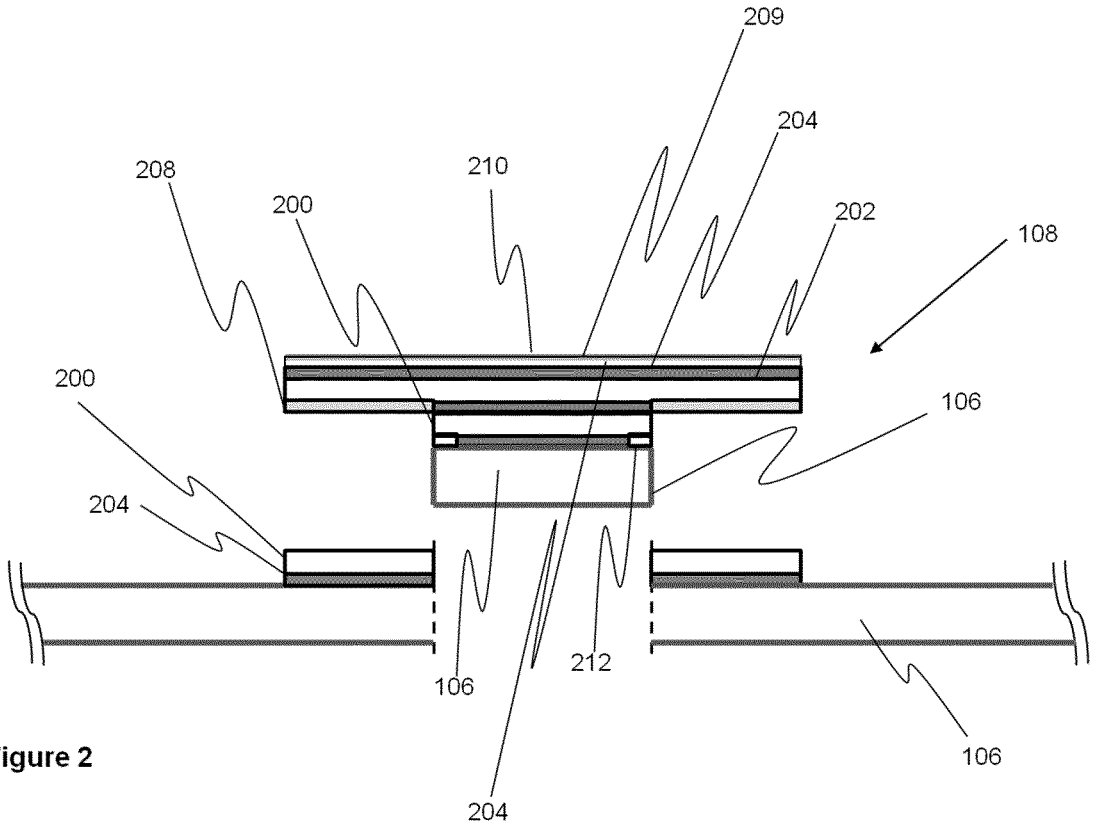
FIG. 2 shows a schematic cross section of the top portion of a resealable container self-adhesive reclosable sticker package in accordance with the present invention as seen from the front, with the resealable self-adhesive sticker in the open position.
Figure 3:
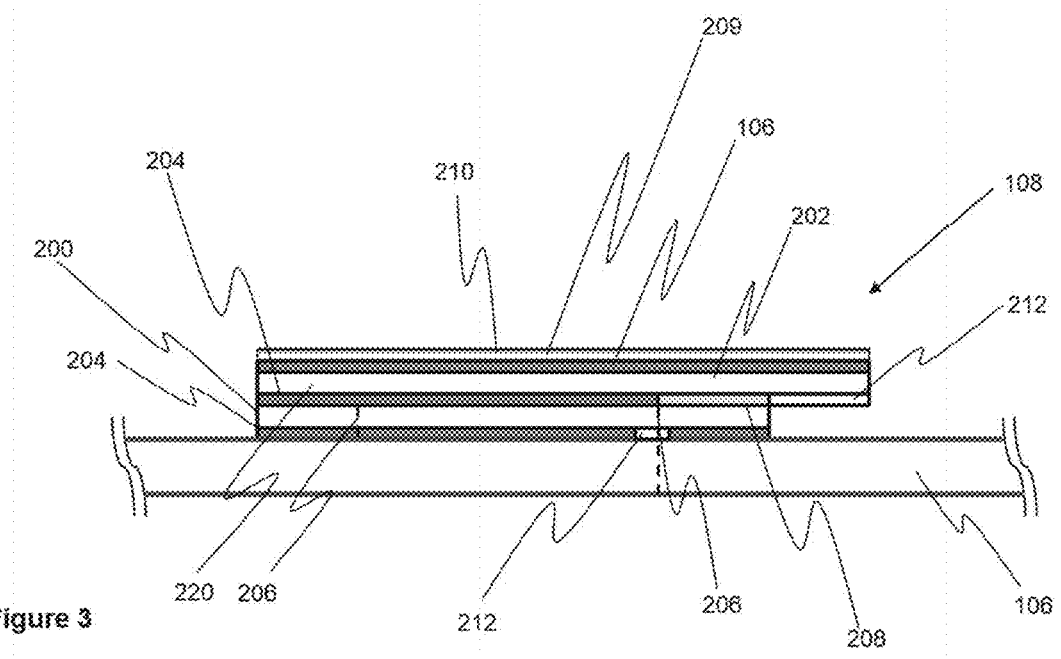
FIG. 3 shows a schematic cross section of the top portion of a resealable container in accordance with the present invention as seen from the side, with the resealable self-adhesive sticker in the closed position.

FIGS. 1 to 3 show cross sections of the top portion of a package 106 for housing a bundle of cigarettes (not shown). The package 106 includes a cut-out providing an access opening through which the cigarettes can be removed. The cut-out of the package 106 is defined by lines of weakness in the package delimiting an access portion of the package 106.

A self-adhesive reclosable sticker 108 is attached to the outer surface of the package 106 so that the self-adhesive reclosable sticker 108 covers the cut-out defining the access opening in the package 106. In more detail, the self-adhesive reclosable sticker 108 extends beyond the periphery of the cut-out of the package 106. As shall be explained in more detail below, this enables a consumer to open and reseal the package 106 until the package 106 is empty. The access portion of the package 106 is partially separated from the remainder of the package along the lines of weakness on first opening the package 106, such that the access portion of the package remains attached to the remainder of the package 106 during subsequent opening and closing of the package.

An inner frame (not shown) is mounted within the package 106. The inner frame comprises an inner frame front wall, an inner frame left side wall and an inner frame right side wall which are connected to the inner surface of the package front wall, package left side wall and package right side wall, respectively. The inner frame front wall includes a rectangular cut out at the top free edge, in order to facilitate removal of the cigarettes from the package 106.

The self-adhesive reclosable sticker 108 comprises a first layer 200 and a second layer 202 formed from webs of a labelling thermoplastic material, such as for example polyethylene therephthalate (PET), polypropylene (PP), oriented polypropylene (OPP).

The first layer 200 is affixed to the package 106 by a first adhesive 204 provided on the inner surface of the first layer 200 extending about a sealing portion of the package 106. The sealing portion of the package is located about the periphery of the access opening. Further, the first layer comprises a cut-out 206 aligned with the access opening of the package. The cut-out 206 in the first layer 200 is defined by lines of weaknesses in the first layer. Thus, the lines of weakness in the first layer 200 define an access portion of the first layer, which is bounded on three sides by the lines of weakness. The access portion of the first layer 200 is partially separated from the remainder of the first layer 200 along the lines of weakness on first opening the self-adhesive reclosable sticker 108, such that the access portion of the first layer 200 remains attached on one side to the remainder of the first layer 200 during subsequent opening and closing of the package 106. Further, the access portion of the first layer 200 is affixed to the access portion of the package.

The second layer 202 is partially releasably affixed to the first layer 200 by a second, removable adhesive 208 provided on a first area of the inner surface of the second layer 202 that extends about the lower periphery of the cut-out 206 in the first layer 200. The peel strength for peeling the first layer 200 from the package 106 is greater than the peel strength for peeling the second layer 202 from the underlying first layer 200 by 20 percent.

When the cover is in the closed position (see FIG. 2) the second adhesive 208 forms a seal between second layer 202 and the first layer 200, and consequently the package 106 to which the first layer 200 is affixed. In addition, the second layer 202 is sealed to the first layer 200 at the upper, back edge of the package using permanent adhesive 204, so that a hinge line is provided about which the self-adhesive reclosable sticker 108 can be pivoted in order to open and close the access opening of the package 106.

A further area of the inner surface of the second layer 202 is permanently affixed to the access portion of the first layer 200 by means of permanent adhesive 204. The second, removable adhesive 208 provided on the first area of the inner surface of the second layer 202 extends about substantially the entire periphery of the access portion of the first layer 200. The second layer 202 is permanently affixed to the first layer 200 by a connection portion 220 extending along an edge of the second layer 202 adjacent an edge of the cut-out 206 in the first layer 200 and located towards the back of the top of the package 106.

In the embodiment shown in FIGS. 1 to 3, the self-adhesive reclosable sticker 108 further comprises an optional top layer film 209 covered by a layer of protective varnish 210. The top layer film 208 is affixed to the second layer 202 by means of permanent adhesive 204. Further, the self-adhesive reclosable sticker 108 comprises an adhesive neutralisation varnish 212 applied on the inner surface of the first layer 200 substantially at the boundary of the access portion of the first layer. This advantageously favours separation of the access portion of the first layer 200 from the remainder of the first layer upon first opening.

As illustrated in FIG. 3, in some embodiments, the self-adhesive reclosable sticker 108 may further comprise an adhesive neutralisation varnish 212 applied on the inner surface of the second layer 202 over a portion of the second layer extending beyond the first later 200 of the self-adhesive reclosable sticker 108. Thus an adhesive free end tab of the self-adhesive reclosable sticker 108 is defined, which is easy to grab for the consumer when opening and closing the self-adhesive reclosable sticker 108 over the access opening of the package 106.

Figure 4:
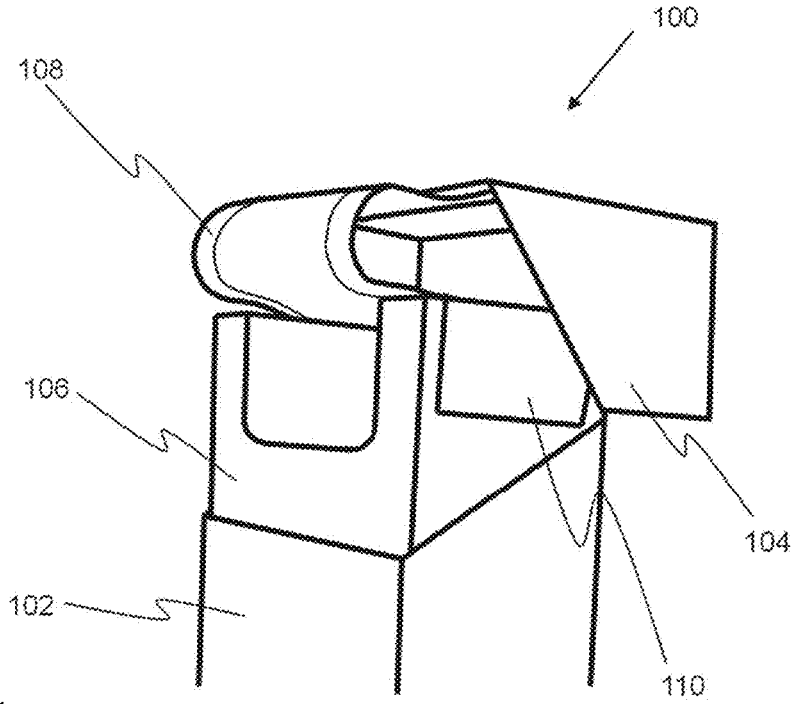
FIG. 4 shows a schematic partial perspective view of a hinge lid container housing a resealable container in accordance with the present invention.

In certain preferred embodiments, a package 106 as described above can be received in a hinge lid container of the type schematically illustrated in FIG. 4. The hinge lid container 100 shown in FIG. 1 is a rectangular parallelepiped and comprises a lower box 102 and an upper lid 104 that is hinged to the box 102 along a hinge line extending substantially horizontally along the back wall of the container 100. FIG. 4 shows the container with the hinge lid 104 in an open position. The overall size and construction of the box 102 and lid 104 of container 100 are substantially the same as that of a standard hinge lid cigarette pack.

The box 102 has a box front wall, a box left side wall, a box right side wall, a box back wall, and a box bottom wall. The upper side of the box 102 is open, to provide an upper opening through which the cigarettes can be removed. When the container in the upright position is open, the cigarettes contained in the box 102 may be removed from the upper end of the hinge lid container 100.

The lid 104 has a lid front wall, a lid left side wall, a lid right side wall, a lid back wall and a lid top wall. When the hinge lid container 100 is closed, the free edges of the walls of the lid 104 abut the free edges of the walls of the box 102 along a line of abutment. In the closed position, the walls of the lid 104 therefore form extensions of the corresponding walls of the box 102 to define the walls of the hinge lid container 100. Prior to the first opening, the container 100 is wrapped in an outer wrapper (not shown) formed of a transparent film, in the conventional manner.

In the embodiment shown in FIG. 4, the self-adhesive reclosable sticker 108 has a pair of flaps 110 extending laterally and permanently affixed to the side walls of the package 106 by a permanent adhesive provided on the inner surface of the flaps 110.

Further, the self-adhesive reclosable sticker 108 is affixed to the surface of the lid 104 so that opening and closing of the lid 104 causes opening and closing of the access opening of the inner package 106. In practice, the second layer 202 of the self-adhesive reclosable sticker 108 is permanently affixed to the lid 104, so that when the lid 104 is pivoted about a hinge line extending across the back wall of the hinge lid container 100, the second layer 202 is peeled off the first layer 200, which, in contrast, lies permanently affixed to the inner package 106.

The invention claimed is:

1. A hinge lid container for consumer goods comprising:

a box;

a lid hinged to the box along a hinge line extending across a back wall of the container; and a resealable package of consumer goods within the box, the package having an access opening through which consumer goods can be removed from an upper end of the hinge lid container, the access opening extending across a top wall and a front wall of the package; and a self-adhesive reclosable sticker covering the access opening of the package and extending beyond the periphery of the access opening of the package, wherein the self-adhesive reclosable sticker comprises at least a first and a second layer, each one of the first and second layer being formed of a respective labelling material web, wherein the first layer of labelling material web is affixed to the package by a first adhesive provided on the inner surface of the first layer extending about at least a sealing portion of the package located at the periphery of the access opening, the first layer comprising a cut-out at least partly aligned with the access opening of the package; and wherein the second layer of labelling material web is at least partially releasably affixed to the first layer by a second adhesive provided on a first area of the inner surface of the second layer extending about at least the lower periphery of the cut-out of the first layer;

the second adhesive being a removable adhesive, and a peel strength for peeling the first layer from the package being greater than a peel strength for peeling the second layer from the first layer;

wherein the second layer of the self-adhesive reclosable sticker is permanently affixed to the first layer by a connection portion extending along an edge of the second layer adjacent an edge of the cut-out in the first layer, the connection portion of the second layer being located towards the back of the top of the package, so that a hinge line is provided about which the second layer of the self-adhesive reclosable sticker can be pivoted in order to open and close the access opening of the package; and wherein a surface of the second layer of the self-adhesive reclosable sticker is permanently affixed by means of adhesive directly to the inner surface of the lid, such that upon pivoting the lid about the hinge line, the lid peels the second layer of the self-adhesive reclosable sticker off the first layer of the self-adhesive reclosable sticker to at least partly reveal the access opening.

2. A container according to claim 1, wherein the peel strength of the first adhesive is greater than the peel strength of the second adhesive by at least 10 percent.

3. A container according to claim 1, wherein the peel strength of the first adhesive is greater than the peel strength of the second adhesive by at least 15 percent.

4. A container according to claim 3, wherein the self-adhesive reclosable sticker comprises a pair of flaps extending laterally and permanently affixed to the side walls of the container by a layer of the first adhesive provided on the inner surface of the flaps.

5. A container according to claim 1, wherein the self-adhesive reclosable sticker comprises a pair of flaps extending laterally and permanently affixed to the side walls of the container by a layer of the first adhesive provided on the inner surface of the flaps.

6. A container according to claim 5, wherein the access opening of the package is defined by one or more lines of weakness in the package.

7. A container according to claim 5, wherein the cut-out of the first layer of the self-adhesive reclosable sticker panel is defined by one or more lines of weakness in the first layer of the self-adhesive reclosable sticker panel; and wherein the self-adhesive reclosable sticker panel comprises a further area of the inner surface of the second layer permanently affixed to the portion of the first layer bounded by the one or more lines of weakness.

8. A container according to claim 1, wherein the access opening of the package is defined by one or more lines of weakness in the package.

9. A container according to claim 1, wherein the cut-out of the first layer of the self-adhesive reclosable sticker panel is defined by one or more lines of weakness in the first layer of the self-adhesive reclosable sticker panel; and wherein the self-adhesive reclosable sticker panel comprises a further area of the inner surface of the second layer permanently affixed to the portion of the first layer bounded by the one or more lines of weakness.

10. A container according to claim 9 further comprising indicia that are hidden to the consumer by the self-adhesive resealable sticker covering the opening access of the package and that become visible when the second layer is peeled off the first layer to reveal the access opening.

11. A container according to claim 9, wherein the second layer of the self-adhesive reclosable sticker is permanently affixed to the inner surface of the lid by a permanent adhesive provided on a second area of the inner surface of the second layer; and wherein a third area of the inner surface of the adhesive label disposed between the first and second areas is substantially free of adhesive.

12. A container according to claim 9, wherein a second area of the inner surface of the second layer is substantially free of adhesive;

wherein the second layer of the self-adhesive reclosable sticker is permanently affixed to the inner surface of the lid by a permanent adhesive provided on a first area of the outer surface of the second layer; and wherein the second area of the inner surface of the second layer and the first area of the outer surface of the second layer at least partially overlie each other.

13. A container according to claim 1, wherein the self-adhesive reclosable sticker cover panel extends beyond the periphery of the access opening of the package by less than 5 millimetres.

14. A container according to claim 1 further comprising indicia that are hidden to the consumer by the self-adhesive resealable sticker covering the opening access of the package and that become visible when the second layer is peeled off the first layer to reveal the access opening.

15. A container according to claim 1, further comprising a reinforcement frame within the package.

16. A container according to claim 1, further comprising a reinforcement frame outside the package, side walls of the reinforcement frame defining the side walls of the container.

17. A container according to claim 1, wherein the consumer goods are smoking articles.

18. A container according to claim 1, wherein the second layer of the self-adhesive reclosable sticker is permanently affixed to the inner surface of the lid by a permanent adhesive provided on a second area of the inner surface of the second layer; and wherein a third area of the inner surface of the adhesive label disposed between the first and second areas is substantially free of adhesive.

19. A container according to claim 1, wherein a second area of the inner surface of the second layer is substantially free of adhesive;

wherein the second layer of the self-adhesive reclosable sticker is permanently affixed to the inner surface of the lid by a permanent adhesive provided on a first area of the outer surface of the second layer; and wherein the second area of the inner surface of the second layer and the first area of the outer surface of the second layer at least partially overlie each other.

* * * * *